United States Patent [19]

Perraud

[11] 4,291,771

[45] Sep. 29, 1981

[54] ROTARY PERCUSSION HYDRAULIC DRILLING MACHINE

[75] Inventor: Raymond J. Perraud, Villeurbanne, France

[73] Assignee: Societe d'Etude et de Construction de Machines pour Toutes Industries S.E.C.O.M.A. Société Anonyme, Meyzieu, France

[21] Appl. No.: 23,325

[22] Filed: Mar. 23, 1979

[30] Foreign Application Priority Data

Jun. 20, 1978 [FR] France ..... 78 18936

[51] Int. Cl.[3] ..... E21C 3/20

[52] U.S. Cl. ..... 173/106; 173/12; 173/DIG. 4

[58] Field of Search ..... 173/48, 12, 105, 106

[56] References Cited

U.S. PATENT DOCUMENTS

| | | | |
|---|---|---|---|
| 3,822,752 | 7/1974 | Montabert | 173/106 |
| 3,908,767 | 9/1975 | Klemm | 173/78 |
| 3,965,799 | 6/1976 | Juvonen et al. | 173/DIG. 4 X |
| 4,006,665 | 2/1977 | Klemm | 91/278 |
| 4,006,783 | 2/1977 | Granholm | 173/105 X |

FOREIGN PATENT DOCUMENTS

| | | | |
|---|---|---|---|
| 1454735 | 8/1966 | France | 173/DIG. 4 |
| 2129276 | 10/1972 | France | 173/DIG. 4 |
| 2274404 | 1/1976 | France | 173/DIG. 4 |
| 2274405 | 1/1976 | France | 173/DIG. 4 |
| 301961 | 4/1978 | U.S.S.R. | 173/134 |
| 612746 | 7/1978 | U.S.S.R. | 173/DIG. 4 |

*Primary Examiner*—Wm. Carter Reynolds
*Attorney, Agent, or Firm*—Karl F. Ross

[57] ABSTRACT

A rotary percussion hydraulic drilling machine has striker piston slidably mounted inside a cylinder which defines a first annular chamber connected to a one-way valve slidably mounted inside a chamber connected to an accumulator comprising a diaphragm, leading to which is a hydraulic fluid inlet pipe and a second annular chamber connected to a control valve. This control valve, governed by the movements of the piston, connects the second chamber alternately to the high pressure pipe and to the return pipe. The valve, constructed in the form of a sleeve and subject to the force of a spring has a lateral connection allowing the direct passage of fluid to the return pipe, a rotary motor being located in the inlet pipe. Thus solely rotary operation for a rate of flow less than a certain threshold value and rotary/percussive operation for rates of flow beyond this threshold value may be obtained.

1 Claim, 6 Drawing Figures

ROTARY PERCUSSION HYDRAULIC DRILLING MACHINE

The present invention relates to a hydraulic rotary and percussive drilling machine.

BACKGROUND OF THE INVENTION

A machine of this type can comprise, for controlling the percussion, a striker piston mounted to slide inside a cylinder which defines, around the piston, a first annular chamber connected by a "high pressure" pipe, to a one-way valve constructed in the form of a sleeve subject to the force of a spring and mounted to slide inside a chamber which is connected to an accumulator comprising a diaphragm and leading to which is a hydraulic fluid inlet pipe and a second annular chamber connected to a control valve with a slide having differential sections connecting said second chamber alternately to the "high pressure" pipe and a return pipe, control of the valve being ensured by a pipe connected to the cylinder.

This type of machine is described in particular in the published French Pat. Nos. 2 274 404 and 2 274 405 corresponding respectively to U.S. Pat. Nos. 3,908,767 and 4,006,665, over which the present invention can be considered as an improvement. In these machines the second annular chamber which is connected alternately to the fluid inlet pipe and the return pipe, by the control valve itself governed by the movements of the piston, has a useful cross section greater than that of the first annular chamber. The latter is permanently connected to the fluid inlet pipe when connection to the latter is established by the one-way valve. This valve, which is also in the form of a slide having differential sections, with a compensating spring, operates such that on the fluid inlet side remains less than a certain threshold value, the spring is slack and the valve closes-off the outlet of the "high pressure" pipe as well as the outlet to the accumulator.

When the pressure exceeds the threshold value in question, the slide moves, thus compressing the spring and releasing the outlet orifices of the "high pressure" pipe and to the accumulator.

This hydraulic device is satisfactory for controlling percussion, but it is not particularly well-suited for a rotary percussion machine, in which the drilling tool is not only struck, but also rotated. Naturally, it is always possible to rotate the tool by a mechanism which is completely independent of the percussion mechanism, which also has the advantage of allowing great operating flexibility, but necessitates two separate pumps and supply circuits. It has already been considered to mount the percussion mechanism and the rotary mechanism "in series" hydraulically (c.f. for example French Pat. Nos. 1 454 735 and 2 129 276 see U.S. Pat. No. 3,822,752), which makes it possible to have a single pump and also to simplify the hydraulic circuits. This solution is less expensive and more reliable, but it makes the rotation completely dependent on the percussion and in particular does not make it possible to rotate the drilling tool while withdrawing the latter, thus without operating the percussion.

OBJECT OF THE INVENTION

The present invention intends to remedy these drawbacks.

SUMMARY OF THE INVENTION

To this end, it relates to a hydraulic drilling machine of the type mentioned in the introduction, in which the sleeve constituting the one-way valve comprises a lateral connection allowing the direct passage of hydraulic fluid to the return pipe, when this valve is located in a position preventing the passage of fluid towards the "high pressure" pipe, whereas a rotary motor is inserted in the inlet pipe.

The rotary motor is thus mounted and supplied "in series" with the percussion device and the originality of the system obtained is to allow the rotation of the drilling tool without initiating percussion, simply by varying the supply rate of flow:

when the rate of flow is less than a predetermined value, the one-way valve is not moved against the force of its spring and it therefore does not allow any supply for percussion, but the passage of fluid through the connection allows the operation solely of the rotary motor;

when the rate of flow becomes greater than the value in question, the one-way valve is moved, thus compressing its spring, so that the fluid no longer passes through the connection, but is directed towards the percussion device, which thus operates at the same time as the rotary motor.

One should note the extreme simplicity of the invention, since the latter is founded on the addition of a simple connection to an existing one-way valve in known hydraulic circuits of the type mentioned in the introduction. Naturally, this valve should be suitably calibrated for its new function, so that the simultaneous operation of the rotation and percussion is obtained from a rate of flow corresponding to a predetermined pressure.

BRIEF DESCRIPTION OF THE DRAWING

The invention will be better understood by means of the ensuing description, referring to the accompanying diagrammatic drawing illustrating an embodiment of the hydraulic circuits of this rotary percussion drilling machine.

SPECIFIC DESCRIPTION

Figure 1:
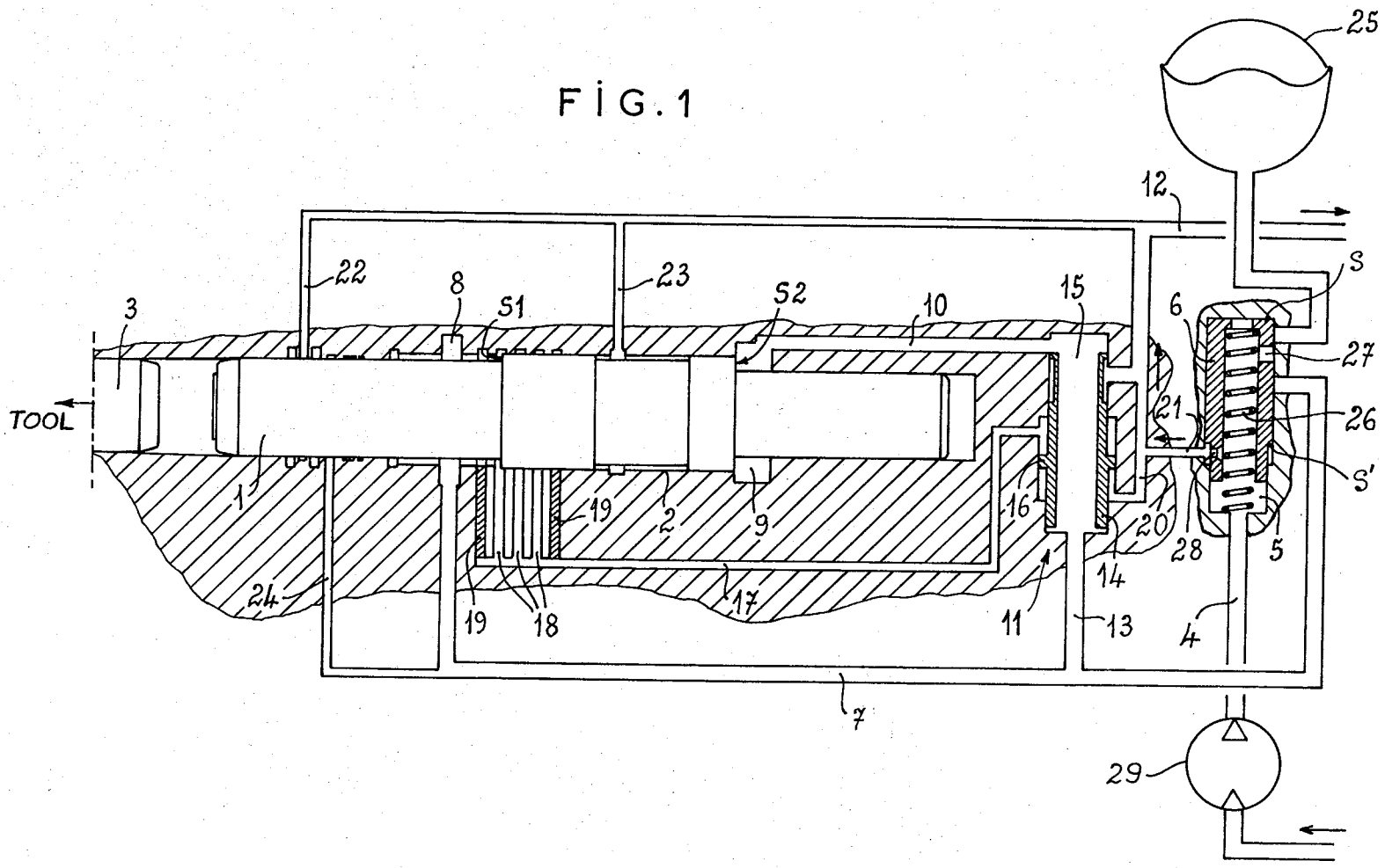
FIG. 1 shows the circuits with the one-way valve in its position allowing rotation without percussion.

The machine comprises a striker piston 1 with two bearings, mounted to slide inside a cylinder 2. This piston periodically strikes a coupling 3, itself connected to a drilling tool which is not shown.

The hydraulic circuits comprise an inlet pipe 4, for supplying the apparatus with hydraulic fluid, the pressure and rate of flow being provided by a pump which is not shown. The pipe 4 leads to a chamber 5 in which a one-way valve 6 is housed. The chamber 5 is connected by a "high pressure" pipe 7 to an annular chamber 8 formed by the cylinder 2 and surrounding the piston 1 on the side nearest the tool coupling 3.

On the other side, the cylinder 2 defines around the piston 1, another annular chamber 9 which is connected by means of a pipe 10 to a control valve 11. This valve is connected at one end to a return pipe 12, at the other end to the "high pressure" pipe 7, by means of a connecting pipe 13.

The control valve 11 is constituted by a slide 14 having differential sections, able to move inside a chamber 15, this slide comprising a flange 16 allowing the control of the valve. A control pipe 17 connects the part of the chamber 15 located on one side of the flange 16 to the cylinder 2, which pipe 17 is sub-divided into several parallel channels 18 which open into said cylinder, at the rear of the annular chamber 8. Certain of these channels are closed-off, partly or completely, by members 19 in the form of rods. Another pipe 20 connects the part of the chamber 15 located on the other side of the flange 16 to the return pipe 12.

It should be noted that this return pipe 12 is also connected to the chamber 5 by a channel 21, to the front of the cylinder 2 by a channel 22 and to the intermediate region of the cylinder 2 by a channel 23, opening out opposite the part of the piston 1 of reduced cross section, located between the two bearings of the latter. The front of the cylinder 2 is also connected by a channel 24 to the "high pressure" pipe 7.

The chamber 5 is connected to an accumulator 25 comprising a diaphragm. The one-way valve 6 housed inside this chamber is constructed in the form of a sliding sleeve, subject to the force of a spring 26 and having a first lateral connection 27 allowing the passage of hydraulic fluid to the "high pressure" pipe 7.

All the arrangements described hitherto are not the subject of the present invention and are already described, in an identical or equivalent form, in published French patent applications Nos. 2 274 404 and 2 274 405 (U.S. Pat. Nos. 3,908,767 and 4,006,665) which were mentioned above.

According to the invention, the sleeve constituting the non-return valve 6 has a second lateral connection 28 allowing the direct passage of hydraulic fluid to the return pipe 12, through the channel 21, in association with a hydraulic rotary motor 29 located in the inlet pipe 4, the operation being as follows:

The spring 26 pushes the one-way valve 6 towards one end of the chamber 5 such that in the absence of any other force, this valve allows the passage of hydraulic fluid through the connection 28, from the inlet pipe 4 to the channel 21, but prevents the passage of fluid to the "high pressure" pipe 7 and to the accumulator 25.

When the rate of flow Q of the fluid remains less than a certain threshold value $q_o$, the pressure drop caused by the flow of fluid through the connection 28 is insufficient to cause the movement of the one-way valve 6 against the force of the spring. In fact, this pressure drop produces a pressure P upstream of the connection equal to the pressure in the return pipe 12 increased by the pressure drop in question. This pressure P, which is to be multiplied by the differential section S of the one-way valve 6, produces a force opposed to the force of the spring 26 and remains less than this force, in absolute value, as long as the rate of flow remains less than the threshold value $q_o$. This differential action is brought about by providing the body 6 as a differential piston having a surface 6 most of whose area is effective, upon the application of fluid pressure thereto, to drive the body 6 downwardly (FIGS. 1 and 2) against the force of the spring 26. The valve member 6 also has oppositely effective surfaces such as that represented at S'. The differential section is thus the difference between the areas of all surfaces effective in the direction of application of pressure to the surface S and the areas of all surfaces effective in the direction of application of pressure to the surface S'. The valve 6 thus remains in a position such that the outlet of the "high pressure" pipe 7 is blocked. The entire flow thus passes directly from the chamber 5 to the return pipe 12. The rotary motor 29 is thus driven, in order to rotate the drilling tool, whereas there is no supply of hydraulic fluid to the percussion device (c.f. FIG. 1).

Figure 2:
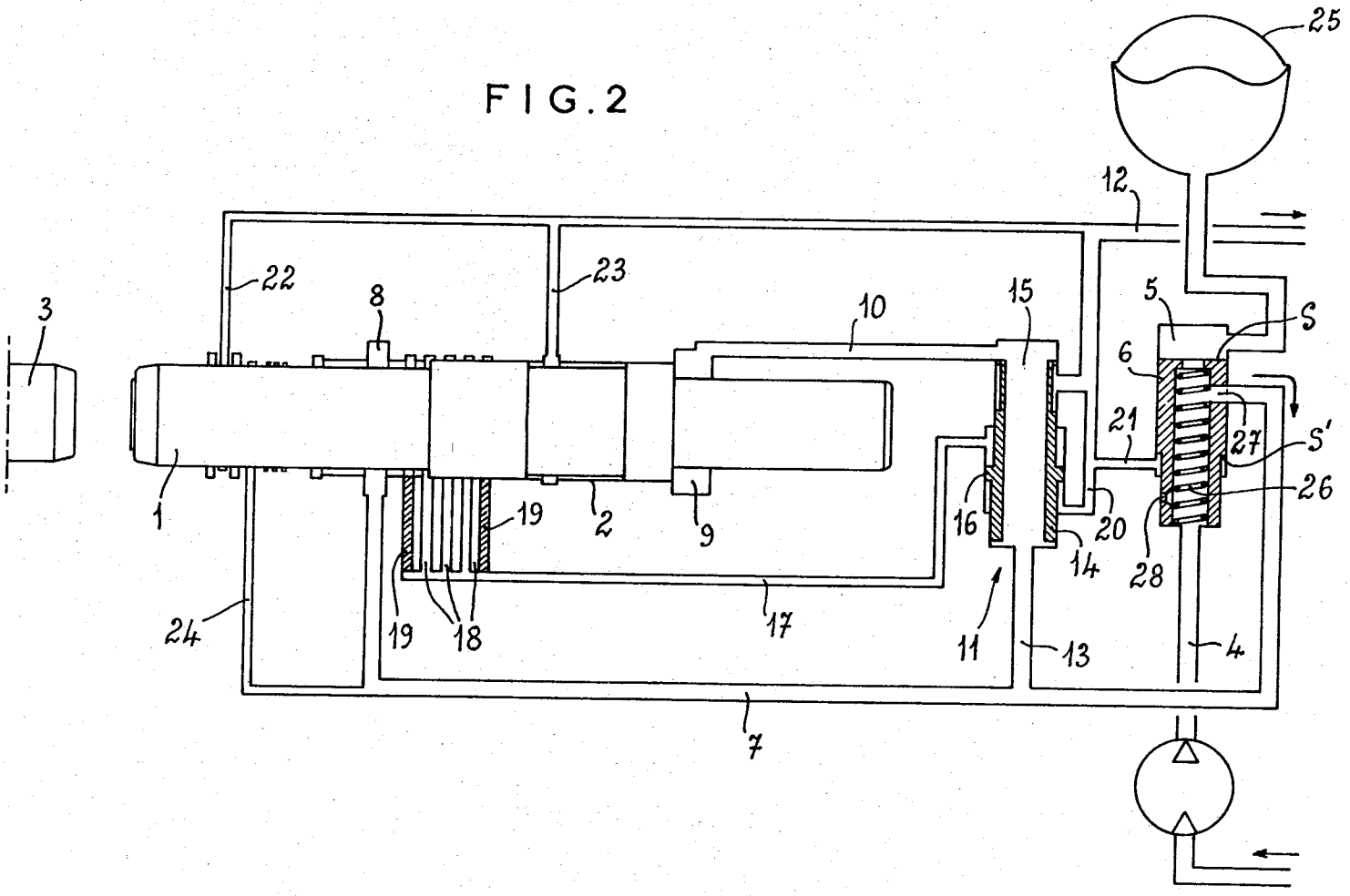
FIG. 2 shows the circuits with the one-way valve in its position allowing simultaneous rotation and percussion.

When the rate of flow q of fluid becomes greater than the threshold value $q_o$, the afore-mentioned pressure P also becomes greater than a certain value po and the resulting force $p \times s$ is thus sufficient to move the non-return valve 6 against the force of the spring 26, thus compressing this spring. The valve 6, pushed towards the other end of the chamber 5, thus closes-off the direct passage to the return pipe 12, through the channel 21, but it opens the passage to the accumulator 25 and to the "high pressure" pipe 7, through the connection 27. In this case, the fluid supplies the rotary motor 29 on the one hand and the percussion device on the other hand, these two systems mounted "in series" operating simultaneously (c.F. FIG. 2).

The cyclic operation of the percussion device, known per se, is recalled hereafter with reference to FIGS. 3 to 6 in order to give a complete description:

The annular chamber 8 is still under pressure, owing to the "high pressure" pipe 7.

The annular chamber 9 may be connected alternately, by the pipe 10 and the valve 11, to the "high pressure" pipe 7 and the return pipe 12.

The intermediate region of the cylinder 2, into which the channel 23 opens, is still connected to the return pipe 12 and constitutes a return chamber for leakages (the channel 22 also serving as a leakage pipe).

The fluid present in the chamber 8 exerts its pressure on a surface S1 of the piston 1 less than the surface S2, on which the pressure of the fluid present in the chamber 9 is exerted.

Figure 3:
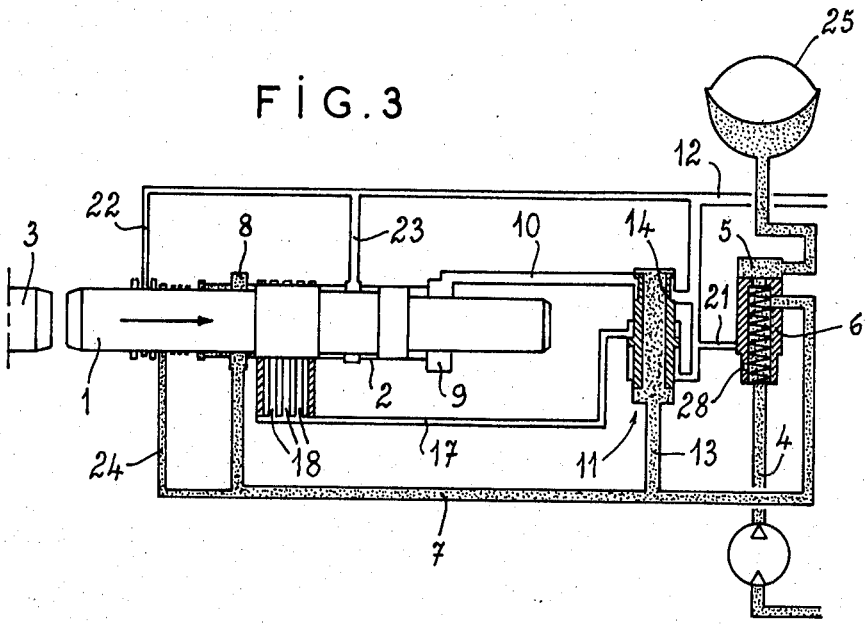
FIGS. 3 to 6 are diagrams explaining the operating cycle of the machine for percussion.

In a first stage of the cycle, namely the stage for the withdrawal of the piston and for the storage of energy, the chamber 8 is under pressure whereas the chamber 9 is connected to the return pipe 12, the slide 14 of the valve 11 occupying its "upper" position. The piston 1 thus draws back and simultaneously the accumulator 25 stores hydraulic fluid under pressure (c.f. FIG. 3).

Figure 4:
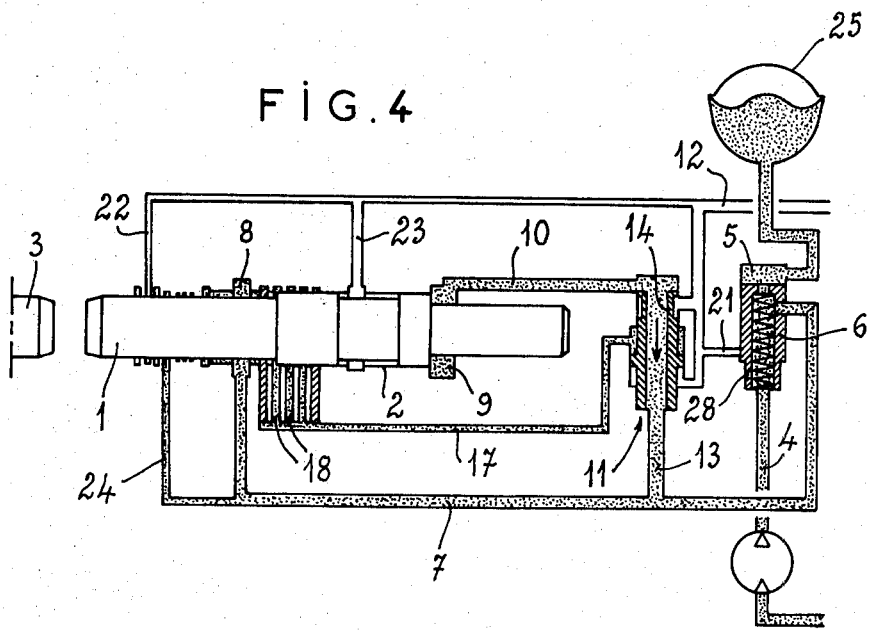

In a second stage of the cycle, namely the stage of the end of rearwards travel and control of the valve, the piston 1 uncovers the control orifices by which the channels 18 open into the cylinder 2. The pressure coming from the chamber 8 thus spreads into the control pipe 17 and moves the slide 14 of the valve 11 towards its "lower" position. The chamber 9 is thus connected to the "high pressure" pipe 7 (c.f. FIG. 4).

Figure 5:
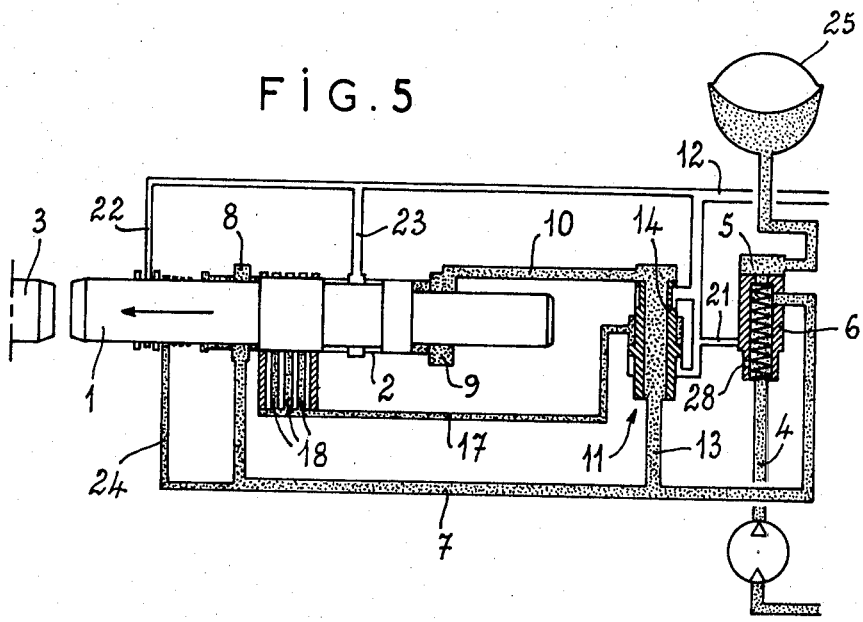

During the following stage, which stage is known as the working and energy restoring stage, the two chambers 8 and 9 are both connected to the "high pressure" pipe 7 and supplied simultaneously by the pump and accumulator 25. Since the useful section S2 of the chamber 9 is greater than the useful section S1 of the chamber 8, the piston 1 is pushed forwards, the fluid from the chamber 8 being expelled into the chamber 9 (c.f. FIG. 5).

Figure 6:
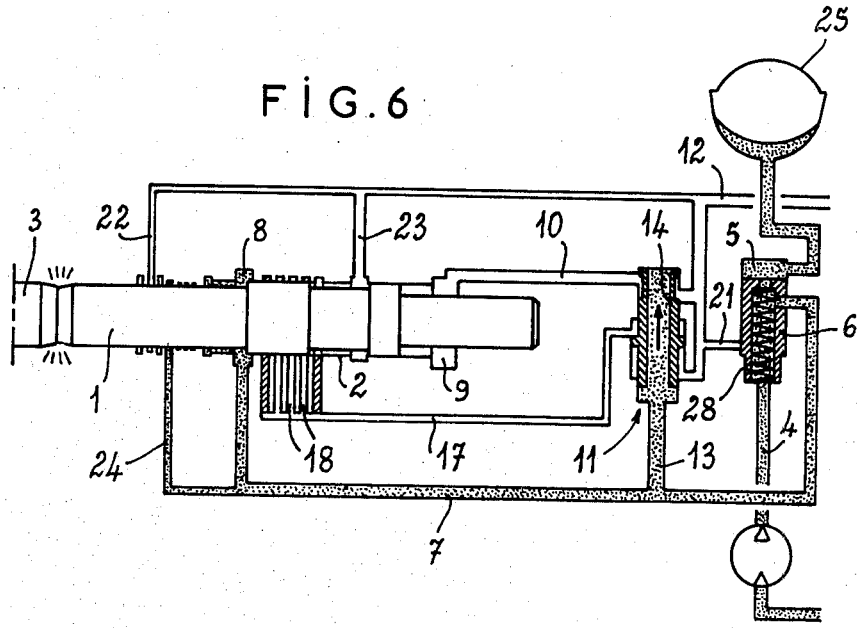

The last stage, namely the stage of impact and control of the valve, occurs when the piston 1, having reached its maximum speed, strikes against the coupling 3. The bearing of the piston 1 uncovers the control orifices by which the channels 18 open into the cylinder 2. The control pipe 17 is thus connected by means of the channel 21 to the return pipe 12. The slide 14 of the valve 11 is restored to its initial "upper" position and the chamber 9 is reconnected to the return pipe 12 (c.f. FIG. 6).

From this position, the piston once more draws back and the same cycle is repeated as long as the supply pressure is adequate. If the rate of flow of hydraulic fluid is reduced below the threshold value $q_o$, the non-return valve 6 is restored to its position shown in FIG. 1 by the spring 26. The orifices for the passage of fluid to the chamber 8, the valve 11 and the accumulator 25 are closed and the latter discharges slowly due to internal leakages of the device.

Naturally, the invention is not limited to the embodiment which was described above by way of example. On the contrary it includes all variations based on the same principle, certain details of the circuits, of the one-way valve and of the control valve being able to be modified without diverging from the scope of the invention.

What is claimed is:

1. In a hydraulic drilling machine comprising a percussion-controlling striker piston mounted to slide inside a cylinder and drive a tool, said cylinder defining, around the piston, a first annular chamber connected by a "high pressure" pipe to a one-way valve in the form of a sleeve subject to a spring force and slidably mounted inside a chamber which is connected to an acumulator comprising a diaphragm and leading to which is a hydraulic fluid inlet pipe and a second annular chamber connected to a control valve with a slide having differential sections connecting said second chamber alternately to the "high pressure" pipe and a return pipe, the control of the control valve being ensured by a pipe connected to the cylinder, the improvement wherein the sleeve constituting the one-way valve has a lateral connection allowing direct passage of the hydraulic fluid to the return pipe, when said valve is in a position preventing the passage of fluid to the "high pressure" pipe, a hydraulic rotary motor for rotating said tool being located in the inlet pipe.

* * * * *